United States Patent [19]

Brown

[11] Patent Number: 4,886,271

[45] Date of Patent: Dec. 12, 1989

[54] RANDOM NUMBER SELECTION DEVICE FOR LOTTERIES AND GAMES

[76] Inventor: Robert L. Brown, P.O. Box 31413, Tucson, Ariz. 85751

[21] Appl. No.: 264,769

[22] Filed: Oct. 31, 1988

[51] Int. Cl.[4] ..... A63F 5/04

[52] U.S. Cl. ..... 273/142 HA

[58] Field of Search ..... 273/142 HA

[56] References Cited

U.S. PATENT DOCUMENTS

| | | | |
|---|---|---|---|
| 1,442,651 | 1/1923 | Gory . | |
| 1,458,468 | 6/1923 | Donner . | |
| 1,646,973 | 10/1927 | Moore . | |
| 2,039,332 | 5/1936 | Morrill | 273/142 HA UX |
| 2,546,441 | 3/1951 | Guthmann | 273/142 HA |
| 3,195,896 | 7/1965 | Markham . | |
| 4,239,225 | 12/1980 | Burnside | 273/143 R |
| 4,674,748 | 6/1987 | Wismer | 273/142 HA X |
| 4,721,309 | 1/1988 | Miesel | 273/148 R |

FOREIGN PATENT DOCUMENTS

| | | | |
|---|---|---|---|
| 3531375 | 3/1987 | Fed. Rep. of Germany | 273/142 HA |

*Primary Examiner*—Anton O. Oechsle

[57] ABSTRACT

An apparatus for randomly selecting numbers in lotteries and games, said device consists of an upper and lower disc, center planar support, having two aperture holes and handle. The upper and lower discs have affixed inertia weights for gyration, and the upper disc bears a number of protruding pegs that is served as a number eliminator. The center support has two viewing ports at a calculated separation on a linear radial from the center axis to align with the opposing numbers group disc. The operation of the device is provided by pure mechanical forces including inertia and hand leverage to provide random numbers in conjunction with a cluster peg disc to conceal given numbers.

6 Claims, 2 Drawing Sheets

RANDOM NUMBER SELECTION DEVICE FOR LOTTERIES AND GAMES

BACKGROUND

1. Field of Invention

This invention relates to game devices, primarily but not limited to lottery number selection devices, that produce randon numbers, and comprises various methods to produce random numbers.

2. Description of Prior Art

Many, if not most number selection devices were designed to function with gear and rapid motion stops or a disc or discs rotated around each other with thumb, and forefinger contact, or opposing directional guidance with the hand. Henceforth, a variety of number selection devices have been proposed and implemented for games of chance, lotteries and the such like.

One such device comes supplied in a compact wallet type case. Numbers are selected by rotating the disc with hand manipulation and choosing color designs through numerous apertures, that indicate a number. This device provides number selection by a great degree of choice rather than randomness. The operator merely through a series of hand manipulations and choosing color coordinates is indicated a choice of numbers to select. The device appears to also be limited to a single function of methods.

Another type of device consists of rotating discs with legend on the bottom discs and numerous apertures on the top disc. The legend on the bottom disc has primarily elliptical shaped legend for slight hand movement of alignment if necessary for more direct character interpretation. This device is also limited to a single scope of operation and does not consider any other mechanical forces to act upon it.

OBJECTS AND ADVANTAGES

Subsequently, I claim the following as the objects and advantages of my invention: to provide an apparatus for randomly picking numbers for lotteries and games of chance that is simple and fun to operate with a minimal amount of instructions, that provides several methods of mechanical forces to act upon it: to be operated effectively with hand-appendage motion or to put in motion with inertia force by utilizing wrist and hand leverage, to provide a lottery number selection device that is compatible with the majority of state run lotteries, to provide a number selection device that has a calculated two hole aperture separation to produce a free rotating positive random number indicator, to provide a revolving cluster peg disc that has the capacity to randomly obscure either number revealed aperture summed as a number eliminator, to provide a random number selection device that is light and durable and small enough to be carried in most shirt pockets, and to provide a lottery number selector device that is unique in design and functionability.

Readers will further understand the embodiment and advantages of the invention from the detailed drawings and ensuing description.

DRAWING FIGURES

DRAWING RERENCE NUMERALS

Figure 1:
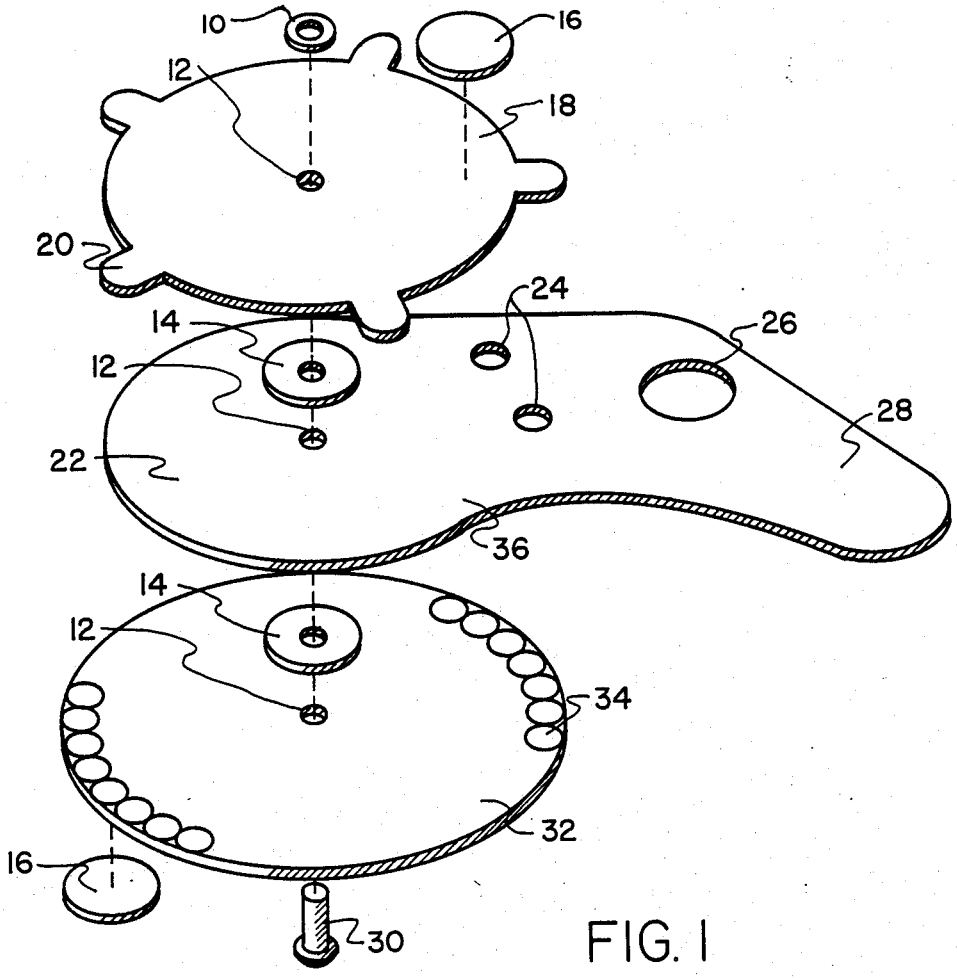
FIG. 1 shows an exploded view of the invention and the main embodiment of the device and parts thereof.

10: upper washer
12: fastener holes
14: washers
16: inertia weights
18: top disc
20: cluster peg
22: center planar support
24: aperture holes
26: thumb rest hole
28: handle
30: fastener
32: bottom disc
34: numbers group
36: radial edge of semi-sphere center support

DESCRIPTION OF THE INVENTION

FIG. 1 shows the preferred embodiment of the invention where disc 18 is approximately 6.5 centimeters in diameter and which also comprises a number of protruding pegs, 20 with a fastener hole 12 and is preferably made of plastic. Center support 22 is what embodies the two aperture holes 24, thumb hole 26, fastener hole 12 and handle 28. Center support 22 is preferably made of plastic and is approximately 14 centimeters in length. Disc 32 is also preferably made of plastic and is about 8.3 centimeters in diameter, bears a fastener hole 12 and to which a group of numbers is attached 34, FIG. 2. One each of two inertia weights 16 is embodied to cluster disc 18 and bottom disc 32. The primary washers 14 rest against the faces of discs 18, 32 and center support 22. Washer 10 then rests upon disc 18, to which fastener 30 is inserted through holes 12, washers 14 and 10 to complete assembly.

OPERATION

Figure 2:
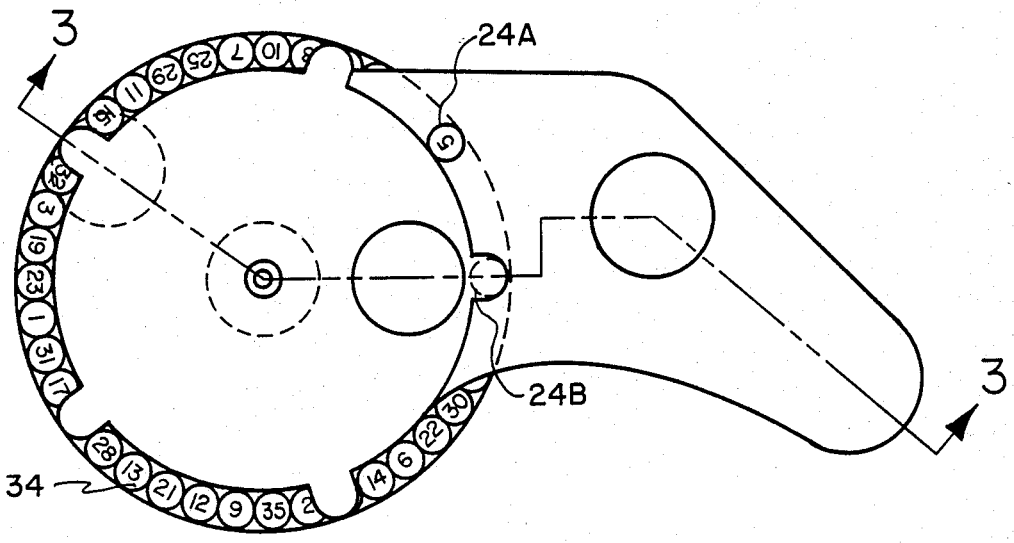
FIG. 2 shows an overhead view of the top and illustrates the invention in an assembled state.
Figure 3:
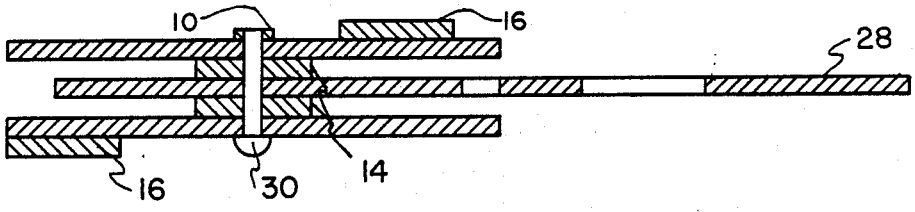
FIG. 3 shows an assembled side view of the apparatus.
Figure 4:
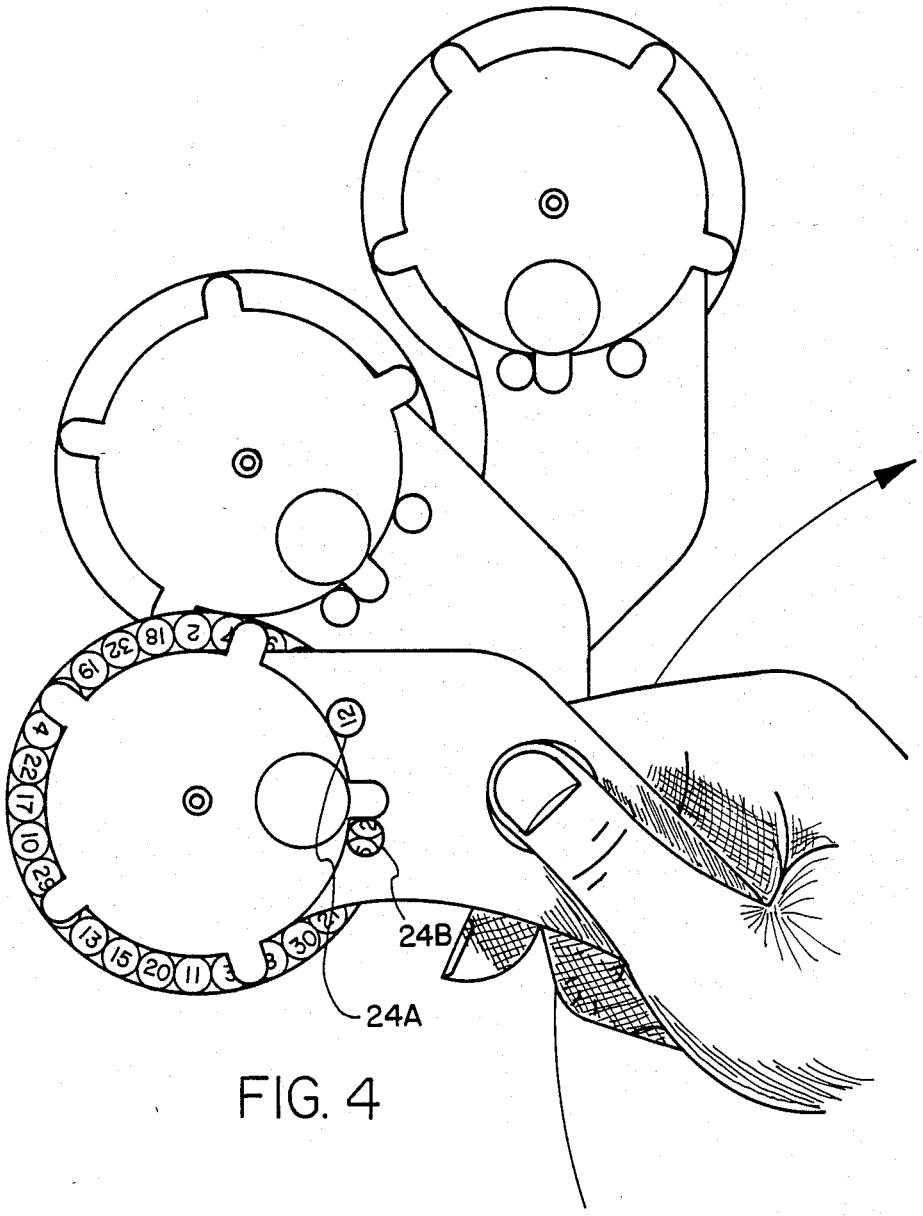
FIG. 4 illustrates the preferred means of operation of the device.

The functionability of the device consists of several methods in which there are two aperture holes computed at a calculated distance apart 24, FIG. 1 and aligned on a equal distant radial from center that apertures 24 will indicate only one number from group 34, FIG. 2 as illustrated in 24A and 24B, FIG. 4.

The apparatus provides several methods of operation, with the primary intent to utilize the inertia weights 16, to gyrate the numbers group disc 32, and cluster peg disc 18, FIG. 1. The operation of the device is best facilitated by placing the thumb on top of hole 26 and grasping with the opposing forefinger to rest underneath handle 28 and utilizing the flicking of wrist action as illustrated in FIG. 4. Once the device is abruptly arched through the air with wrist action the inertia weights 16 gyrate the discs 32 and 18. Again as illustrated in 24A and 24B, FIG. 4 after the discs come to rest a number will be in view in one or the other of two aperture holes 24, while the remaining aperture hole will contain a plurality of numbers that wont be readable such as in 24B, FIG. 4. This is one of the features of the invention, that two seperated apertures, aligned on the equal distant radial, opposing the radial numbers group, and calculated at a formulated distance apart will always indicate a readable numbers, as opposed to a single aperture which would be a hit and miss situation.

One must realize that when one picks a set of say, six numbers out of a possible say, forty-nine numbers the chances are greatest that you won't select the same six numbers chosen by your state lottery. Therefore I have included a number eliminator which comprises disc 18, and contains a cluster of pegs 20, FIG. 1. The gyrating disc 18 will frequently obscure either aperture hole 24*a* or 24*b* as can be visualized in FIG. 2, if it obscures a readable number you must spin again till you have your required amount of numbers. Also an alternate method of choosing numbers if so desired would be to select the numbers that are hidden by peg 20, FIG. 2 which would provide you another strategy of number selection.

Another method of operating the device if you choose not to use a combination of wrist action and inertia force to gyrate discs 18, and 32 is to place a finger so as to make contact with peg 20 and edge of disc 32, FIG. 1, and spin with the finger which will supply results simular to wrist action, FIG. 4. In fact the discs can be gyrated on any suitable surface that isn't too harsh or abrasive. While the discs are gyrating, washers 14 will allow the discs to spin rapidly with little friction interference.

Although the handle of the device was designed for ease of operation by the majority of us who are right handed, by removing fastener 30, and flipping center planar support 22, over 180 degrees, and reassembling in the same part sequence, ease of operation can be facilitated for left handed people as well.

MULTIPLE USE—GAMES

The apparatus could also be used with games and gaming boards, to be used for number and character selection, or other applications that may require a random selection of legends.

While the above description contains many specificities, the reader should not interpret these as limitations on the scope of the invention, but merely as exemplifications of preferred embodiments thereof. Those skilled in the art will envision many other possible variations are within it's scope. For example skilled artisans will readily be able to change the dimensions and shapes of the various embodiments. In lieu of the inertia weights 16, FIG. 1, for example, the discs 18, and 32 could be manufactured with a mold in a extrusion process, that would allow the plastic discs, 18 and 32, to be thicker and heavier on one edge of each disc, thereby achieving a self sufficient inertia capability. They can also add six rows of numbers on the numbers group disc 34, FIG. 2 and add twelve aperture holes to produce six numbers on one spin instead of one number per toss. They can add magnification lenses to the aperture holes to enlarge the legend. They can alter the invention such as eliminating center support 22, FIG. 1, and form a handle on to disc 32, while retaining disc 18, without pegs 20, and embodying aperture holes 24, FIG. 1 to disc 18, so that the aperture holes will gyrate around the numbers group disc 32, thereby utilizing the two hole aperture seperation in another form. They can add or delete the number of pegs 20, FIG. 1 to disc 18. They can add a spring and ball actuated disc stop mechanism. In fact they can embody a trigger mechanism or other means of mechanical force to gyrate the discs. They can produce it from any number of composite materials or fiber board. They will be able to make it with unique color variations. Accordingly the reader is requested to determine the scope of the invention by the appended claims and their legal equivalents, and not by the examples which have been given.

What is claimed is:

1. A device for random number selection that includes random number elimination comprising:

an upper disc with a number of protruding pegs extending radially outward from center of said disc and a center planar support bearing view ports with a partial spherical circumference at one end with said support serving as a handle with a thumb rest hole at the opposite end, a lower disc bearing radially aligned indicia extending outward from its center in a circular concentric pattern and a means of embodying an imbalance of weight to outer circumference areas of said discs in an isolated proportion, a means of connecting said lower disc and said upper disc to said center planar support so said disc will gyrate relative to one another on a common axis and relative to said center planar support's partial spherical circumference wherein the pegs of said upper disc when gyrated will radially align with said center support's said view ports, wherein said lower disc when gyrated will revolve its concentric indicia to align with said center support's view ports and opposing pegs of said upper disc and wherein there exists a computed separation and alignment of said radially positioned view ports whereby said view ports will indicate a whole indicia in one or the other of said view ports.

2. A device according to claim 1 wherein said embodied weight means to outer circumference areas of said discs are for the purpose of causing inertia force to act upon said discs.

3. A device according to claim 2 where wrist torque and hand leverage of the handle will allow inertia forces to act upon the discs in a gyrating manner.

4. A device according to claim 1 wherein said view ports are apertures and said indicia are numbers.

5. A device according to claim 1 wherein said weight means causes said discs to gyrate in unison independently of each other.

6. A method of using the device of claim 1 wherein the upper disc bearing cluster pegs is caused to gyrate in a circular path over the center planar support bearing view ports and the opposing lower disc bearing concentrically aligned indicia by which said view ports intersect the circular paths of said cluster pegs of the upper disc and said numerals group of said lower disc wherein said pegs when gyrating may rest to stop upon a view port where said numeral aligned with the view port would be hidden requiring the operator to choose a numeral from the remaining view port or replay the device.

* * * * *